US006711785B1

(12) United States Patent
Hicks et al.

(10) Patent No.: US 6,711,785 B1
(45) Date of Patent: Mar. 30, 2004

(54) LANYARD CONNECTOR AND SYSTEM

(76) Inventors: Bryan K. Hicks, 4875 Mountain La., Salt Lake City, UT (US) 84124; Brandon Robert Mackay, 2243 E. 3380 South, Salt Lake City, UT (US) 84109

( * ) Notice: Subject to any disclaimer, the term of this patent is extended or adjusted under 35 U.S.C. 154(b) by 0 days.

(21) Appl. No.: 09/931,658

(22) Filed: Aug. 16, 2001

Related U.S. Application Data

(63) Continuation-in-part of application No. 09/541,297, filed on Apr. 3, 2000, which is a continuation-in-part of application No. 09/538,956, filed on Mar. 31, 2000, which is a continuation-in-part of application No. 29/106,139, filed on Jun. 9, 1999, now Pat. No. Des. 437,485, which is a continuation-in-part of application No. 29/105,931, filed on Jun. 4, 1999, now Pat. No. Des. 422,142, which is a continuation-in-part of application No. 29/105,930, filed on Jun. 4, 1999, now Pat. No. Des. 426,063.

(51) Int. Cl.[7] ..... A44B 11/25
(52) U.S. Cl. ..... 24/3.4; 24/625; 24/3.1
(58) Field of Search ..... 24/3.4, 3.13, 13, 24/115 A–115 R, 132 A–132 R, 135 A–135 R, 136 A–136 R, 127, 128, 129–129 W, 132 AA, 132 W, 265 AL, 265 B, 509, 511, 588, 590, 509.1–600.1, 305, 312, 316, 318, 336, 600.2–600.9, 618, 625, 628, 639, DIG. 23, 429, 614–619, 662, 664–667, 671, 672

(56) References Cited

U.S. PATENT DOCUMENTS

| | | | | | |
|---|---|---|---|---|---|
| 658,124 | A | | 9/1900 | Semple | |
| 664,814 | A | | 12/1900 | Manes | |
| 751,090 | A | | 2/1904 | Marold | |
| 967,664 | A | | 8/1910 | Peterson | |
| 1,130,438 | A | * | 3/1915 | Schmidt | 24/598.1 |
| 1,565,932 | A | | 12/1925 | Powers | |
| 1,879,991 | A | * | 9/1932 | Pratt | 224/258 |
| 2,412,895 | A | | 12/1946 | Lewis | 87/8 |
| 2,481,946 | A | | 9/1949 | Pendelton | |
| 2,539,922 | A | | 1/1951 | Nyberg | |
| 2,585,089 | A | | 2/1952 | Caldwell et al. | 24/DIG. 22 |
| 2,704,961 | A | | 3/1955 | Weil | |
| 2,947,456 | A | * | 8/1960 | Seron | 224/258 |
| 3,397,026 | A | | 8/1968 | Spina | |
| 3,450,467 | A | | 6/1969 | Phillips | |
| 3,502,396 | A | | 3/1970 | Greenberg | |
| 3,551,963 | A | | 1/1971 | Mosher, Jr. et al. | |

(List continued on next page.)

FOREIGN PATENT DOCUMENTS

| | | | | |
|---|---|---|---|---|
| DE | 3837261 | | 5/1990 | 24/265 EC |
| EP | 0058772 | | 6/1985 | |
| FR | 2746933 | | 10/1997 | |
| GB | 891022 | | 3/1962 | |
| GB | 2268050 | | 1/1994 | |
| JP | 411-103910 | * | 8/1999 | 24/429 |

OTHER PUBLICATIONS

Amendment "A", p. 8, Remarks, Disclosures relating to lanyards sold on information and belief, prior to Mar., 1999.

(List continued on next page.)

*Primary Examiner*—Robert J. Sandy
*Assistant Examiner*—Ruth C. Rodriguez
(74) *Attorney, Agent, or Firm*—Workman Nydegger; David B. Dellenbach

(57) ABSTRACT

A lanyard system conveniently suspends entry badges, keys or other objects about the neck. The system comprises a connector having a male buckle portion and a female buckle portion. The male buckle portion has an attachment coupling thereon such that the male buckle portion can be selectively mounted within a female buckle portion and can selectively receive an attachment thereon. Knobs on the sides of the connector provide a convenient gripping surface.

13 Claims, 7 Drawing Sheets

U.S. PATENT DOCUMENTS

| | | | | | |
|---|---|---|---|---|---|
| 3,600,917 | A | | 8/1971 | Krock | |
| 3,874,776 | A | | 4/1975 | Seron | |
| 3,879,804 | A | | 4/1975 | Lawrence | |
| 3,896,527 | A | | 7/1975 | Miller et al. | 24/81 HS |
| 3,957,237 | A | * | 5/1976 | Campbell | 248/694 |
| 3,979,795 | A | | 9/1976 | Seron | |
| 4,136,934 | A | | 1/1979 | Seron | |
| 4,319,384 | A | | 3/1982 | Horne | |
| 4,379,358 | A | * | 4/1983 | Wibrow | 24/136 R |
| 4,387,490 | A | | 6/1983 | Blackburn et al. | 24/200 |
| 4,441,677 | A | | 4/1984 | Byerly | 248/74.3 |
| 4,577,374 | A | | 3/1986 | Lii | |
| 4,586,499 | A | | 5/1986 | Kaletzky | 128/171 |
| 4,692,970 | A | | 9/1987 | Anthony et al. | 24/642 |
| 4,694,544 | A | * | 9/1987 | Chapman | 24/625 |
| 4,788,755 | A | * | 12/1988 | Kasai | 24/136 R |
| 4,790,646 | A | | 12/1988 | Seron | |
| 4,795,069 | A | | 1/1989 | Ferrill | 224/202 |
| 4,868,954 | A | | 9/1989 | Kasai | |
| 4,909,298 | A | * | 3/1990 | Langhart et al. | 160/178.1 R |
| 4,932,362 | A | | 6/1990 | Birchmire, III et al. | |
| 5,027,477 | A | * | 7/1991 | Seron | 24/3.4 |
| 5,121,865 | A | | 6/1992 | Howard | 224/253 |
| 5,127,137 | A | | 7/1992 | Krauss | |
| 5,136,756 | A | | 8/1992 | Krauss | 24/265 H |
| 5,148,582 | A | * | 9/1992 | Dennis, Jr. | 24/625 |
| 5,191,363 | A | | 3/1993 | Smith et al. | |
| 5,216,786 | A | | 6/1993 | Anscher | 24/200 |
| 5,224,245 | A | * | 7/1993 | Matoba | 24/115 G |
| 5,274,887 | A | | 1/1994 | Fudaki | 24/265 H |
| 5,365,642 | A | | 11/1994 | Rekuc et al. | 24/600.9 |
| 5,367,347 | A | | 11/1994 | Wilson et al. | |
| 5,379,496 | A | * | 1/1995 | Krauss | 24/625 |
| 5,414,903 | A | | 5/1995 | Porteous | 24/9 |
| 5,454,140 | A | * | 10/1995 | Murai | 24/136 R |
| 5,471,716 | A | * | 12/1995 | Takahashi | 24/615 |
| 5,475,901 | A | | 12/1995 | Anscher | 24/265 H |
| 5,477,593 | A | * | 12/1995 | Leick | 24/712.5 |
| 5,561,891 | A | | 10/1996 | Hsieh | 24/573.1 |
| 5,582,337 | A | | 12/1996 | McPherson et al. | 224/660 |
| D381,891 | S | * | 8/1997 | Anscher | D8/383 |
| 5,669,119 | A | * | 9/1997 | Seron | 24/265 H |
| 5,671,508 | A | * | 9/1997 | Murai | 24/115 K |
| 5,689,860 | A | | 11/1997 | Matoba et al. | 24/115 F |
| 5,740,952 | A | | 4/1998 | Huckenbeck | |
| 5,832,573 | A | | 11/1998 | Howell | |
| 5,842,256 | A | * | 12/1998 | Anscher | 24/3.4 |
| 5,855,057 | A | | 1/1999 | Anscher | 24/614 |
| D405,723 | S | | 2/1999 | Anscher | D11/216 |
| D405,724 | S | | 2/1999 | Anscher | D11/216 |
| 5,893,199 | A | | 4/1999 | Anscher | 24/625 |
| 5,894,639 | A | * | 4/1999 | Boden et al. | 24/115 G |
| 5,930,874 | A | * | 8/1999 | Yamazaki et al. | 24/429 |
| 5,933,925 | A | | 8/1999 | Anscher et al. | 24/163 R |
| 5,974,637 | A | | 11/1999 | Tracy et al. | 24/633 |
| 6,000,109 | A | | 12/1999 | Anscher | 24/614 |
| 6,003,928 | A | * | 12/1999 | Curtindale | 296/97.9 |
| D422,142 | S | | 4/2000 | Hicks et al. | D3/318 |
| 6,044,527 | A | * | 4/2000 | Ishida et al. | 24/129 R |
| D426,063 | S | | 6/2000 | Hicks et al. | D3/318 |
| 6,161,266 | A | * | 12/2000 | Anscher | 24/625 |
| D437,485 | S | | 2/2001 | Hicks et al. | D3/318 |
| 6,182,334 | B1 | | 2/2001 | Davancens | |
| 6,209,176 | B1 | * | 4/2001 | Anscher | 24/429 |
| 6,226,844 | B1 | * | 5/2001 | Lerra et al. | |

OTHER PUBLICATIONS

Snugz USA Product Catalog, Jan. 1997.
Snugz USA Product Catalog, Jan. 1999.
Snugz USA Product Catalog, Jan. 2000.
Fields 2000 Collection Eyewear and Outdoor Accessories & Gifts, available on information and belief, Jan., 2000.
Duraflex 2000 Brochure, National Molding Corporation, Copyright 1999.
U.S. Provisional Patent Application to Hicks et al., Serial No. 60/088,262, filed Jun. 5, 1998.
U.S. Design Patent Application to Hicks et al., Serial No. 29/105,931, filed Jun. 4, 1999.
Notice of Allowance for U.S. Design Patent Application to Hicks et al., Serial No. 29/105,931, filed Jun. 4, 1999.
U.S. Design Patent Application to Hicks et al., Serial No. 29/105,930, filed Jun. 4, 1999.
Notice of Allowance for U.S. Design Patent Application to Hicks et al., Serial No. 29/105,930, filed Jun. 4, 1999.
U.S. Design Patent Application to Hicks et al., Serial No. 29/106,139, filed Jun. 9, 1999.
Notice of Allowance for U.S. Design Patent Application to Hicks et al., Serial No. 29/106,139, filed Jun. 9, 1999.
Snugz USA, Inc. Website, Dated Oct. 3, 2000.
EK Ekcessories, Inc. Website, Dated Apr. 4, 2000.
Photographs (taken Oct., 2000) of lanyard, on information and belief, sold after Jun., 1998, and prior to Mar. 31, 2000, with attachment member selectively coupled thereto.

* cited by examiner

LANYARD CONNECTOR AND SYSTEM

RELATED APPLICATIONS

This application is a continuation-in-part of U.S. patent application Ser. No. 09/541,297, filed Apr. 3, 2000 entitled "Lanyard Connector and System" to Hicks et al, which is incorporated herein by reference, and which,is a continuation-in-part of U.S. patent application Ser. No. 09/538,956 filed Mar. 31, 2000 entitled "Lanyard Connector and System" to Hicks et al, which is incorporated herein by reference, and which is a continuation-in-part of U.S. Design patent application Ser. No. 29/106,139 (now U.S. Pat. No. D437,485) filed Jun. 9, 1999, entitled "Lanyard Connector" to Hicks, et al, which is incorporated herein by reference, and which is a continuation-in-part of (i) U.S. design patent application Ser. No. 29/105,931, filed Jun. 4, 1999 (now U.S. Pat. No. D 422,142) entitled "Lanyard Connector, which is incorporated herein by reference;" and a CIP of (ii) U.S. design patent application Ser. No. 29/105,930, filed Jun. 4, 1999 (now U.S. Pat. No. D 426,063), entitled "Lanyard Connector," which is incorporated herein by reference.

BACKGROUND OF THE INVENTION

1. The Field of the Invention

This invention is in the field of lanyards. More specifically, this invention is in the field of connectors that connect lanyards to one or more attachments.

2. State of the Art

A lanyard is a cord, strap, line or other such member used to hold or fasten to an object. Lanyards are often worn about the neck of a user. A lanyard connector connects the first and second ends of a lanyard substrate (e.g., a strap or cord) together, forming a circular assembly. A variety of different lanyards and lanyard connectors are presently available within the art.

Lanyard connectors also typically connect to an attachment, such as a clip. The clip may clip to another object, such as a security badge, for example, which a user desires to wear about the user's neck. However, typical lanyard technology fails to offer modular connectors that conveniently connect to a variety of different attachments. Past designs and solutions have typically been made from off the shelf available components. Components have been sourced from a variety of designs and/or sources, e.g., VELCRO, crimps, snaps, hooks, buckles, sewing, glue, sonic welding, and rings.

These prior solutions required a number of steps in the manufacturing process to modify and/or prepare the available componentry and/or substrates for functional compatibility. Furthermore, once manufactured, there was typically no possibility for retrofitting for dual or changing use of a product.

In addition, recent technology requires products that are not electrically conductive or static retaining. An integrated system is needed that can cost effectively satisfy that need. Furthermore, as for market acceptability, because typical products are made from existing off-the-self components, it is difficult to maintain a competitive advantage in either price or design employing typical products.

In addition, typical lanyard technology includes rounded lanyard connectors that are difficult to decorate and fail to lay flat against the body of a user.

There is therefore a need in the art for improved lanyard systems which feature modular componentry and lanyard connectors which conveniently connect to a variety of different attachments.

There is also a need in the art for a lanyard system featuring the use of a convenient lanyard connector and modular components selectively coupled thereto that is non-conductive and convenient to manufacture and use.

There is also a need in the art for a lanyard connector that is convenient to decorate and lays flat against the body of a user.

SUMMARY OF THE INVENTION

It is therefore an object of the invention to provide a modular lanyard system for selectively coupling a variety of different items to a variety of different lanyard substrates.

It is another object of the invention to provide a modular lanyard system in which a variety of different attachments can be selectively coupled to a lanyard connector.

It is another object of the invention to provide a lanyard connector and/or lanyard substrate which lays flat against the body of a wearer.

It is another object of the invention to provide a lanyard connector which allows an attachment to rotate with respect to the lanyard connector.

It is another object of the invention to provide a lanyard connector that is convenient to decorate or place a logo on.

It is another object of the invention to provide an integrated system of componentry within a lanyard system.

It is another object of the invention to provide a lanyard connector that allows attachments to be retrofit thereon.

It is another object of the invention to incorporate the flexibility of post manufacture redesign and retrofit.

It is another object of the invention to produce final assembled products with limited or no electrical conductivity or static retention.

It is another object of the invention to provide a system component that will provide a safety release if required by the market or the product design.

It is another object of the invention to reduce decoration (e.g., screen printing, pad printing, hot stamping) and spoilage costs of manufactured items, such as by employing a recylable system.

It is another object of the invention to create a system that is both visually and functionally unique.

It is another object of the invention to connect dissimilar or unrelated substrates with a novel modular system.

It is another object of the invention to provide a number of different manners for connecting and disconnecting a lanyard connector from an attachment.

It is another object of the invention to provide a lanyard system having a variety of different interchangeable parts.

The present invention relates to a universally interchangeable linking or attachment system for securing a variety of items to a variety of lanyard substrates so as to accommodate or achieve a variety of uses and/or applications. The modular system has interchangeable components that aesthetically connect or interact with each other. The system has component multiple-use capability.

One embodiment of the lanyard system of the present invention comprises (i) a lanyard substrate, such as a fabric strap, (ii) a lanyard connector which couples the first and second ends of the substrate together; and (iii) an attachment that selectively, rotatably couples to the lanyard connector. The lanyard connector can attach to a variety of different modular attachments, each of which can be configured to selectively, rotatably couple to the connector, thus achieving modularity and interchangability.

An integrated system of componentry creating simple or complex solutions to needs of products is achieved by employing compatible attachments that allow for reduced inventory requirements.

The invented system employs a novel internal securing design, including upper and lower teeth that grip the substrate ends. The system also provides for economical decoration, personalization and business identification processes which are key to the promotional products industry. Economical decoration can be achieved, for example, by employing a flat or substantially flat lanyard connector on which an insignia such as a logo can be readily placed, as opposed to a round connector that is more difficult to place a logo on.

Items which can be held by the lanyard systems of the present invention include, but are not limited to cameras, trade show badges, security and safety identification badges, workplace name/photo identification, hidden personal and travel safety items, binoculars and umbrellas, luggage tags, zipper pulls or attachment points for flashlights, whistles, keys, cards, personal security/protection devices, etc for bags, cases, packs and carrying devices of all types.

Novel devices that can be created by this system include, but are not be limited to, neck lanyards and other types of lanyards. These may be employed for various types of uses and may have non-conductive and non-static storing properties. These properties have significant and important application where clean areas of manufacturing and services are required, including but not limited to the computer industry, scientific research and development, and medical and pharmaceutical environments.

In order to achieve this non-conductive capability, in one embodiment, the system of the present invention provides modular system thermo-plastic fastening and connecting component devices. For example, through the use of high-tech, engineering grade, UV protected thermo molding plastics, a durable component system is created that will allow for component disassembly and use changes without compromising the integrity of the product. Such plastics also have non-conductive and non-static storing properties and can thus be conveniently employed for lanyard connectors and attachments of the present invention.

Lanyard connectors and attachments of the present invention may be comprised of a variety of different materials, such as a thermoplastic material that is readily injection moldable and nonconductive, e.g., CELCON plastic, nylon, polypropylene, and/or DELRIN. The use of plastic components with the non conductive substrates give a unique and novel system for clean room use.

Lanyard substrates that can be coupled to the lanyard connector may be comprised of woven, braided and/or knitted natural and/or synthetic materials, neoprene, rubber or similar natural or synthetic materials, for example. These materials can be in a variety of different forms, such as straps, cords, lines, and a variety of different shapes and designs which fit about the neck of a user, for example.

In one embodiment of the present invention, a two-part configuration of the lanyard connector allows a portion of the connector to (i) selectively couple to a variety of different lanyard substrates, such as straps, cords, lines, and other members having a variety of different shapes and designs; and (ii) selectively couple to a variety of different attachments. Thus, the user can selectively decouple the attachment from the lanyard substrate (e.g., a strap) by selectively decoupling an attachment directly from a lanyard connector or by selectively decoupling a first portion of the connector from a second portion of the connector.

For example, one embodiment of the lanyard connector body comprises: (i) a first portion that is coupled to the ends of the lanyard substrate; and (ii) a second portion that is selectively coupled to the first portion. A coupling portion extends from the lanyard connector body to thereby allow selective attachment of an attachment to the lanyard connector, such that a user can: (A) selectively attach an attachment to the coupling portion; and (B) selectively attach the first portion of the connector body to the second portion of the connector body.

The two part configuration may be a male/female buckle combination, for example. The first portion may be a female or male portion, while the second portion may be a corresponding male or female portion, for example, that is selectively coupled to the corresponding portion. The coupling portion is, by way of example, a split neck. Such a two-part connector allows a user to attach or detach an attachment to the connector and also allows a user to attach or detach one portion of the connector from another portion. The connector portions and attachment may require different amounts of force to be exerted in order to be coupled or decoupled, for example. Therefore, providing these different options provides a user diversity and choice in connecting to a particular attachment.

In one male/female buckle embodiment, for example, the male buckle has first and second connection points: a rotating connection point at one end and a buckling connection point at an opposing end. This male buckle portion is a dual male portion, having a male connection on each of the opposing sides of the buckle portion. Thus, the male buckle portion is modular on both ends of the male buckle portion, not merely on one end of the male buckle portion.

For example, if the user employs a variety of different lanyard straps and a variety of different attachments, the user can use the same male buckle portion to couple the lanyard straps to each of the respective attachments.

Additional objects and advantages of the invention will be set forth in description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
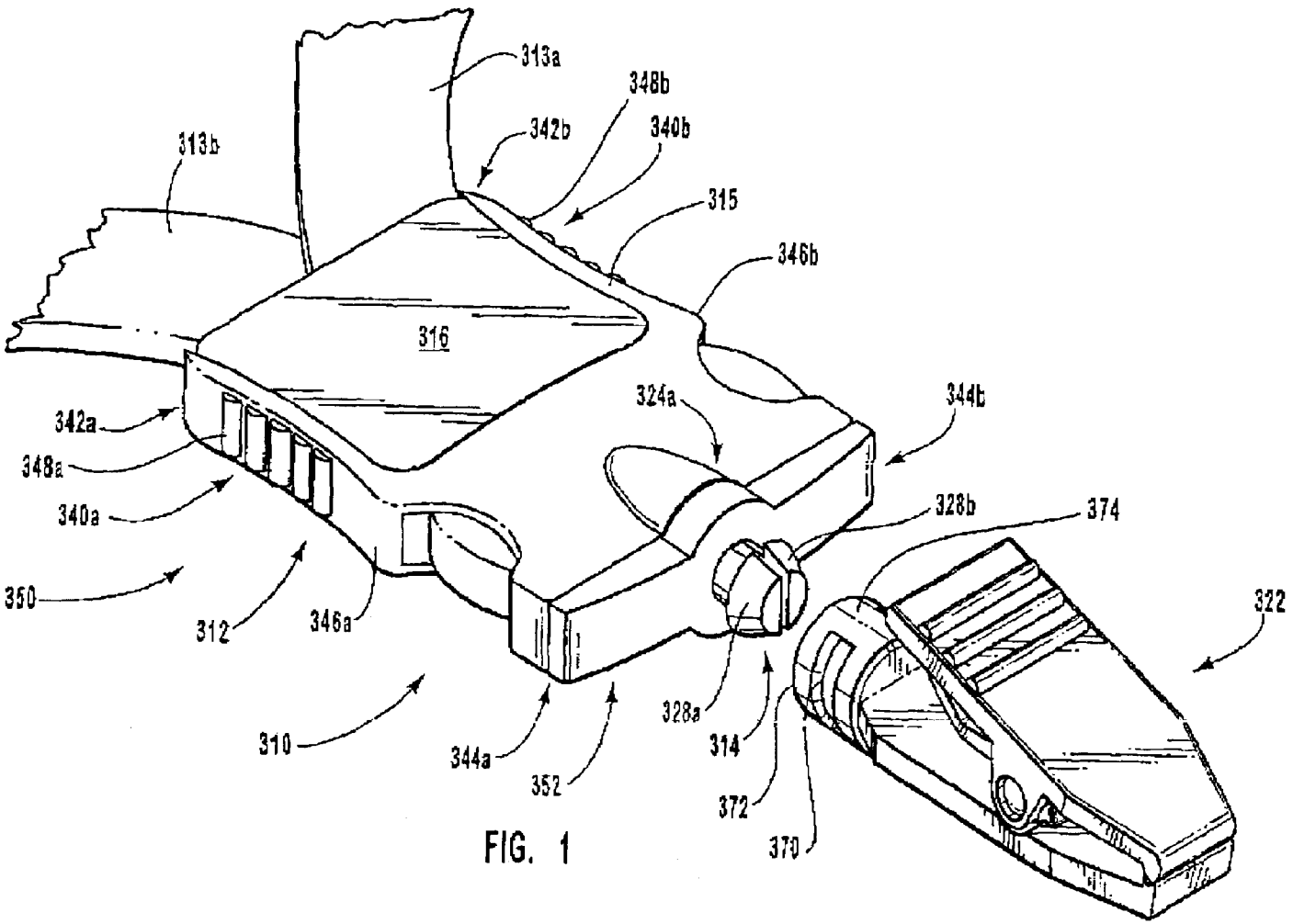
FIG. 1 is a perspective view of a lanyard system of the present invention.

FIG. 1 demonstrates an example of a lanyard connector 310 of the present invention that is capable of modular coupling to a variety of different attachments. Lanyard connector 310 has a substantially flat, preferably nonconductive (e.g., plastic), body 312 that is capable of receiving the solid ends 313*a–b* of a lanyard substrate worn around the neck of a user in a relatively flat fashion. Extending from body 312 is a universal connector neck portion 314 that allows convenient, rotatable connection to many different attachments, such as the attachment 322 shown in FIGS. 1 (detached) and 1*a* (attached) and in U.S. Design Pat. No. 420,800, entitled "Clip," issued Feb. 22/2000 to Hicks, et al, which is incorporated herein by reference. Connector 310 thus has a body portion 312 and a neck portion 314 extending therefrom. Neck 314 serves as a coupling portion to which an attachment may be coupled.

Figure 2:
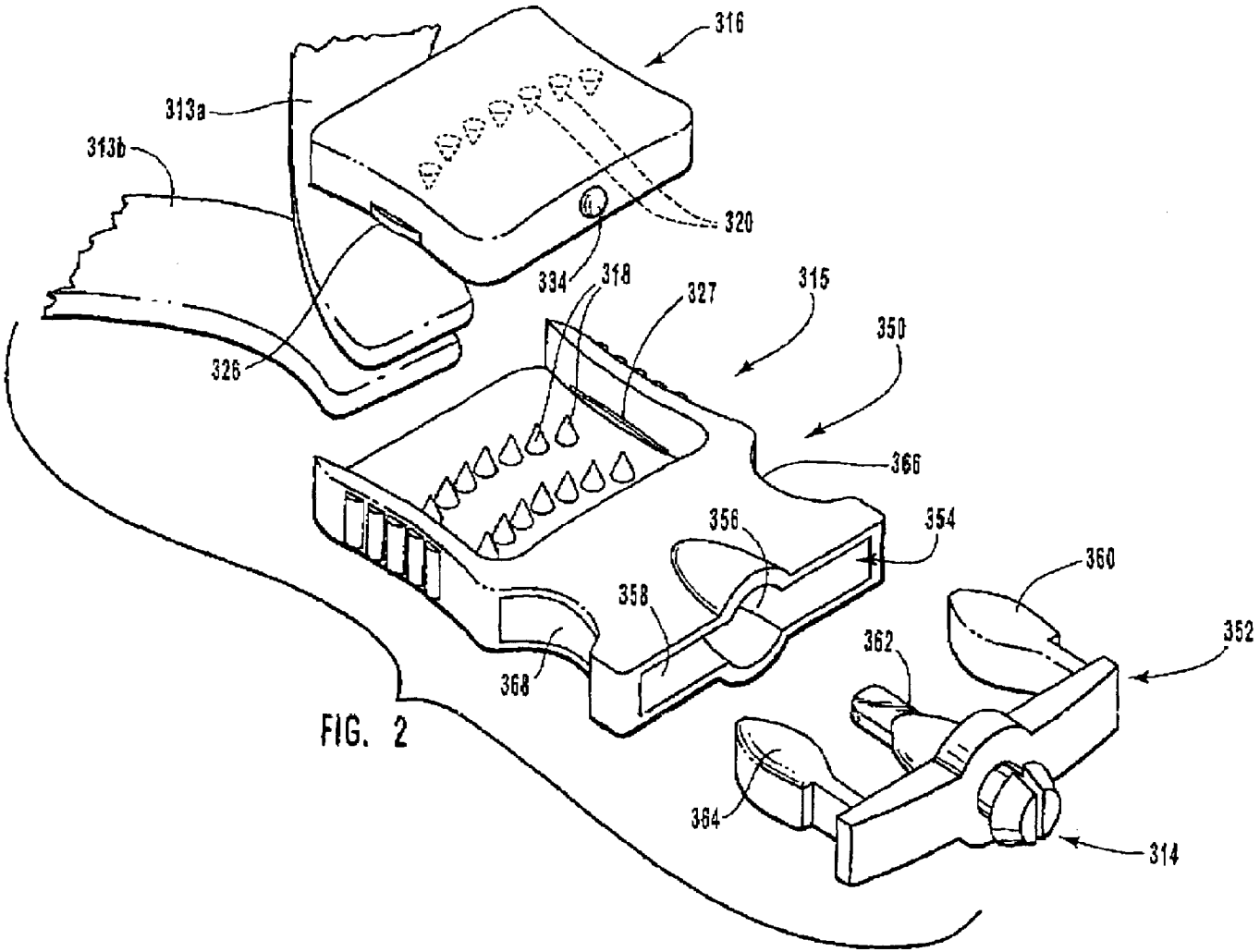
FIG. 2 is an exploded view of the lanyard connector of FIG. 1.

As shown in FIGS. 1 and 2, body 312 comprises: (i) a female buckle portion 350; and (ii) a male buckle portion 352 selectively coupled thereto. Neck 314 extends from the the male buckling portion 352. Thus, a user can optionally detach the male buckling portion 352 from the female buckling portion 350 or detach an attachment from the neck 314 to remove the attachment from the lanyard.

Female buckling portion 350 has a female clamping portion 315 and a male clamping portion 316 which is selectively mounted within female clamping portion 315 to thereby maintain the substrate ends 313*a–b* of a lanyard substrate therebetween. Male and female clamping portions 316, 315, respectively, are mounted on first and second opposing ends 313*a–b* of a lanyard substrate to thereby secure the lanyard substrate ends 313*a–b* within body 312. Upon securing the lanyard substrate ends within body 312, the resulting lanyard can be conveniently worn about the neck of a user.

With continued reference to FIGS. 1 and 2, female buckling portion 350 further has upper and lower sets of teeth 318, 320 (teeth 320 shown in phantom lines) mounted on respective opposing female and male clamping portions 315, 316. Teeth 318, 320, as shown, are configured such that upon mounting the ends 313*a–b* of the lanyard substrate between the male and female clamping portions 316, 315 and coupling the male and female portions 316, 315 together, the ends of the lanyard substrate are clamped between teeth 318, 320 such that the ends of the lanyard substrate are affixed within lanyard connector body 312. Teeth 318, 320 can be employed to selectively secure the opposing ends of a variety of different lanyard substrates within connector body 312, such as cords, straps, and lines and a variety of other members, to thereby cause the lanyard to be held about a user's neck, for example, in a circular assembly. In one embodiment, only a single set of teeth is employed on the female or male portion. For example, a single set of teeth may be employed in the male portion 316 that fits between dual sets of teeth in the female portion 315 during assembly.

Male and female clamping portions 316, 315 can be held together in a variety of different manners, such as through friction fit between adjacent sides of the members, adhesion, or through the mechanical coupling of mating ridges 326 and grooves 327 on opposing sides of respective members, for example, as depicted in FIG. 2. While only one ridge 326 and groove 327 are shown in FIG. 2, both sides of male portion 316 preferably have a ridge 326 thereon, each of which fit into corresponding grooves 327 in female portion 315.

Figure 3:
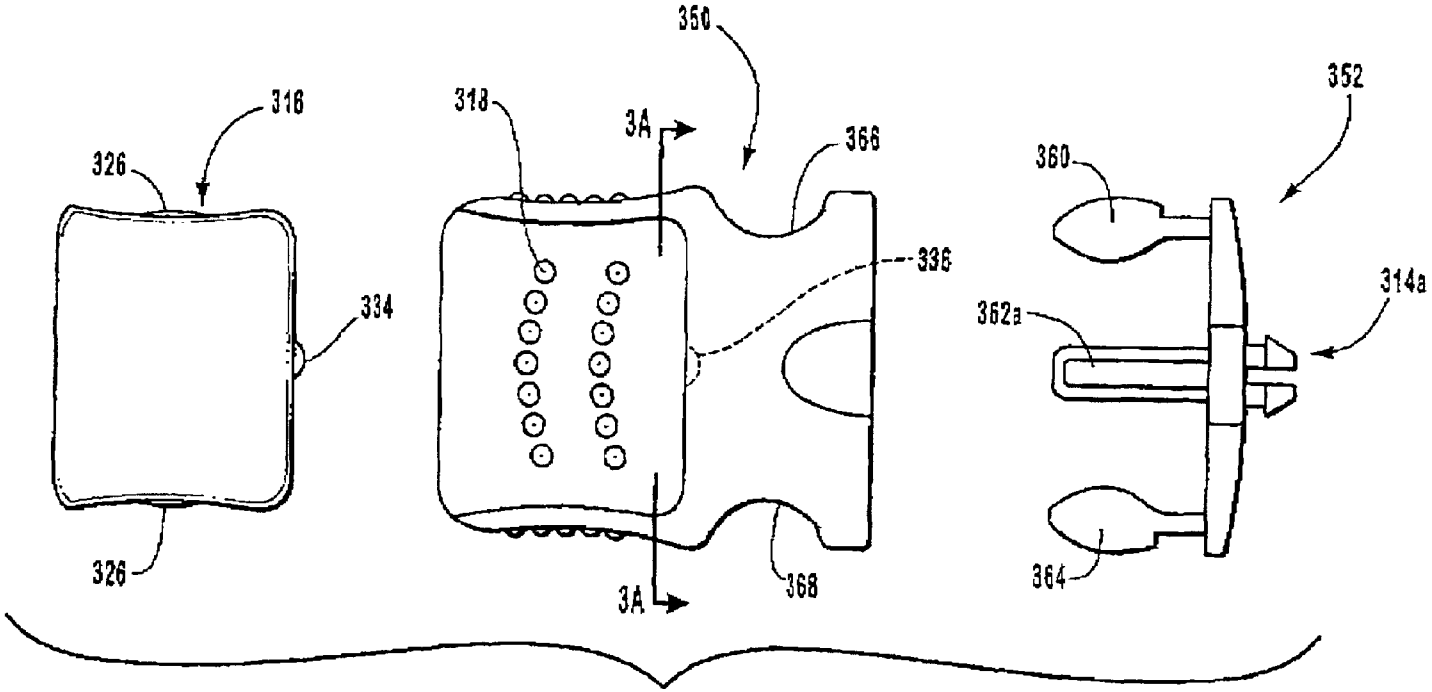
FIG. 3 is an exploded top plan view of the lanyard connector of FIG. 1 with a socket portion depicted in phantom lines, and with an alternate central protuberance 362*a* shown.
Figure 3A:
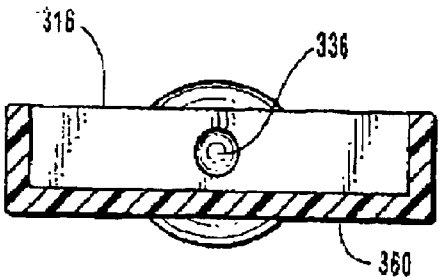
FIG. 3A is a view taken along lines 3A—3A of FIG. 3 demonstrating a socket configured to receive a ball portion.

With reference to FIGS. 2–3A, in addition to the mating ridges and grooves, a mating ball 334 and socket 336 (FIGS. 3–3A) may be employed to assist in orienting the male and female portions 316, 315 and maintaining the male and female portions in desired positions with respect to each other. The ball portion 334 may be disposed on the male portion while the socket portion may be disposed on the female portion, for example. The ball 334 is shown in FIGS. 2 and 3, while the socket is shown in FIG. 3A and in phantom lines in FIG. 3. In one embodiment, during assembly, the ball is oriented within the socket, after which the ridges 326 are pressed into the grooves 327 to thereby sandwich the lanyard substrate ends between the male and female portions 316, 315. While the embodiment of FIG. 9 does not show the ball in the alternate male clamping portion 316*a*, in another embodiment, the male clamping portion 316*a* of FIG. 9 employs a ball while the female portion 315*a* employs a socket, or vice versa.

Also as shown, body 312 further has side gripping grooves 340*a*, 340*b* which enable a user to conveniently grasp lanyard connector 310 on the sides thereof. Grooves 340*a*, 340*b* taper inwardly from proximal shoulders 342*a*, 342*b* and distal shoulders 346*a*, 346*b* (see FIG. 8). The opposing sidewalls of body 312 have a series of knobs 348*a*–348*b* thereon which enhance gripping of the surfaces. Knobs 348*a–b*, which can be rounded, square-shaped or a variety of different shapes and configurations are examples of means for enhancing the gripping surface of connector 310. Other embodiments of means for enhancing include knurled surfaces, uneven surfaces, and a variety of other gripping surfaces known to one skilled in the art. Knobs 340*a–b* can also serve to ameliorate the appearance of a molding line that can occur in certain molding processes along the sidewalls.

As further shown in FIGS. 1–6, body 312 includes integral bulbous distal portions 324*a*, 324*b*. Neck portion 314 shown comprises a split distal neck 314 extending from the collective, combined bulbous portions 324*a*, 324*b*. Bulbous distal portions 324*a*, 324*b* allow a convenient matching interface with a rotating attachment coupled to neck 314, such that the attachment makes a substantially seamless transition with the bulbous distal portions.

The substantially flat male and female portions 316, 315 are part of substantially flat body 312 and conveniently allow insignia, such as a logo, to be stamped, molded, painted, or otherwise formed thereon.

With reference now to FIGS. 4–7, split distal neck 314 comprises right and left neck members 328*a*, 328*b* extending individually from male buckle portion 352 and spaced apart from each other. Each member 328*a*, 328*b* has a substantially semicircular cross section, such that neck 314 overall has a substantially circular cross section. The right and left neck members 328*a*, 328*b* collectively form a split neck 314 to which an attachment can be selectively coupled and about which an attachment can selectively rotate. In one embodiment, the neck members of split neck 314 can flex inwardly when being mounted within the base of an attachment, then flex outwardly to maintain (e.g., temporarily) the neck within the base.

Each neck member 328*a*, 328*b* comprises a thinner proximal member 330*a*, 330*b* (FIG. 4), respectively and a distal wider skirt member 332*a*, 332*b*, respectively, extending therefrom. The proximal members 330*a*, 330*b* collectively form a proximal portion having a substantially circular cross sectional configuration and the skirt members 332*a*, 332*b* collectively form a skirt portion which tapers proximally, widening as they proceed toward the male buckle portion 352.

It will also be appreciated that split neck 314 allows an attachment member to be selectively mounted thereon by pressing at least a portion of an attachment member over the skirted members 332*a*, 332*b*. Skirt members 332*a*, 332*b*, which collectively form a skirt with a substantially circular cross section, can at least temporarily prevent the attachment from being moved off the neck 314 as the attachment rotates neck 314.

Split neck 14 allows the skirt portions 332*a*, 332*b* to flex inwardly with respect to each other as the attachment member is mounted thereon. After the mounting of the attachment member 322 thereon, as shown for example in FIG. 1*a*, the skirt members 332*a*–*b* spring outwardly again, thereby maintaining at least a portion of the attachment member rotating about the thinner portions 330*a*, 330*b* (FIG. 4) between the skirted portions and the male coupling portion 352.

Figure 1A:
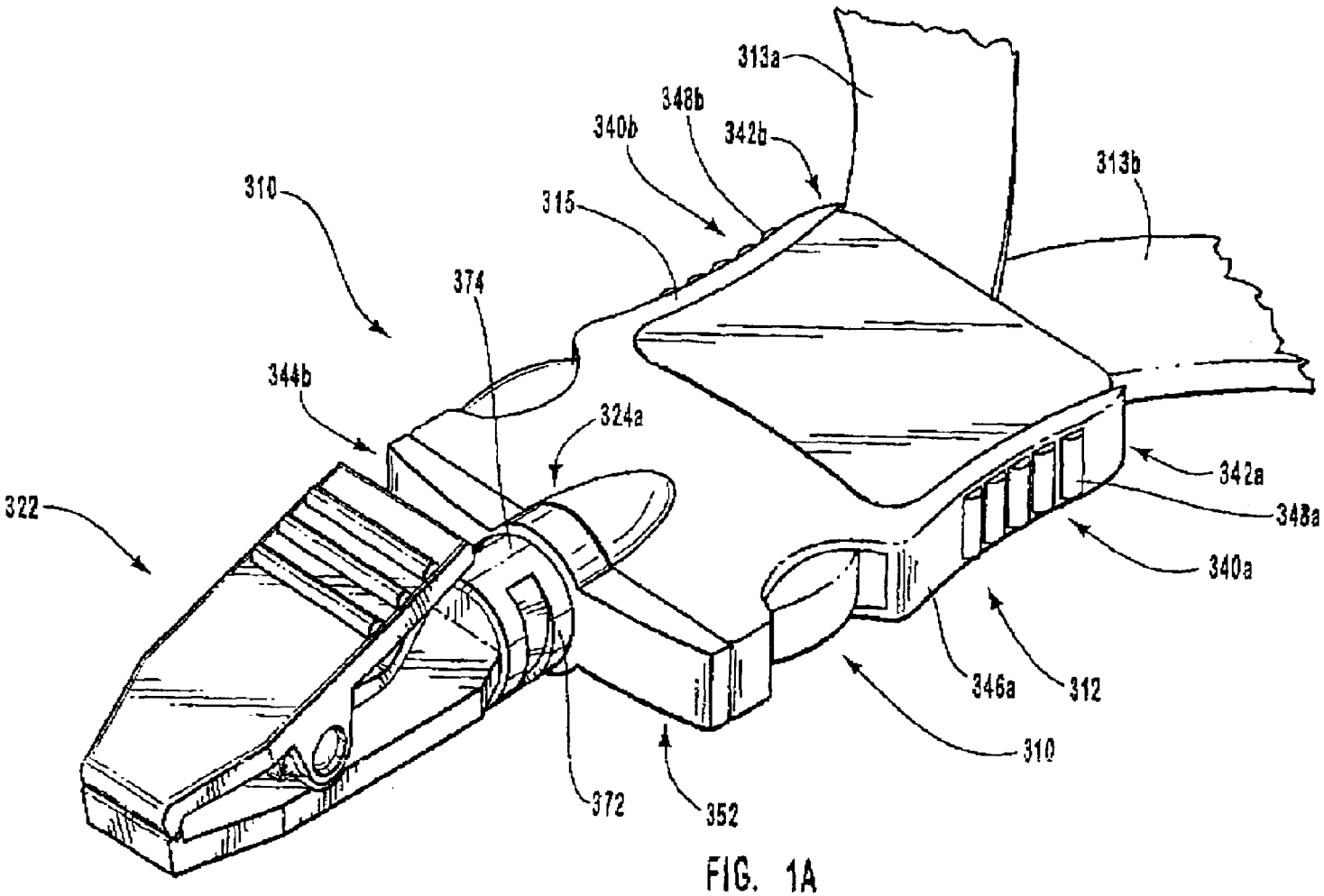
FIG. 1*a* is a perspective view of a lanyard system of the present invention with an attachment rotatably coupled to the lanyard connector.
Figures 4A, 8:
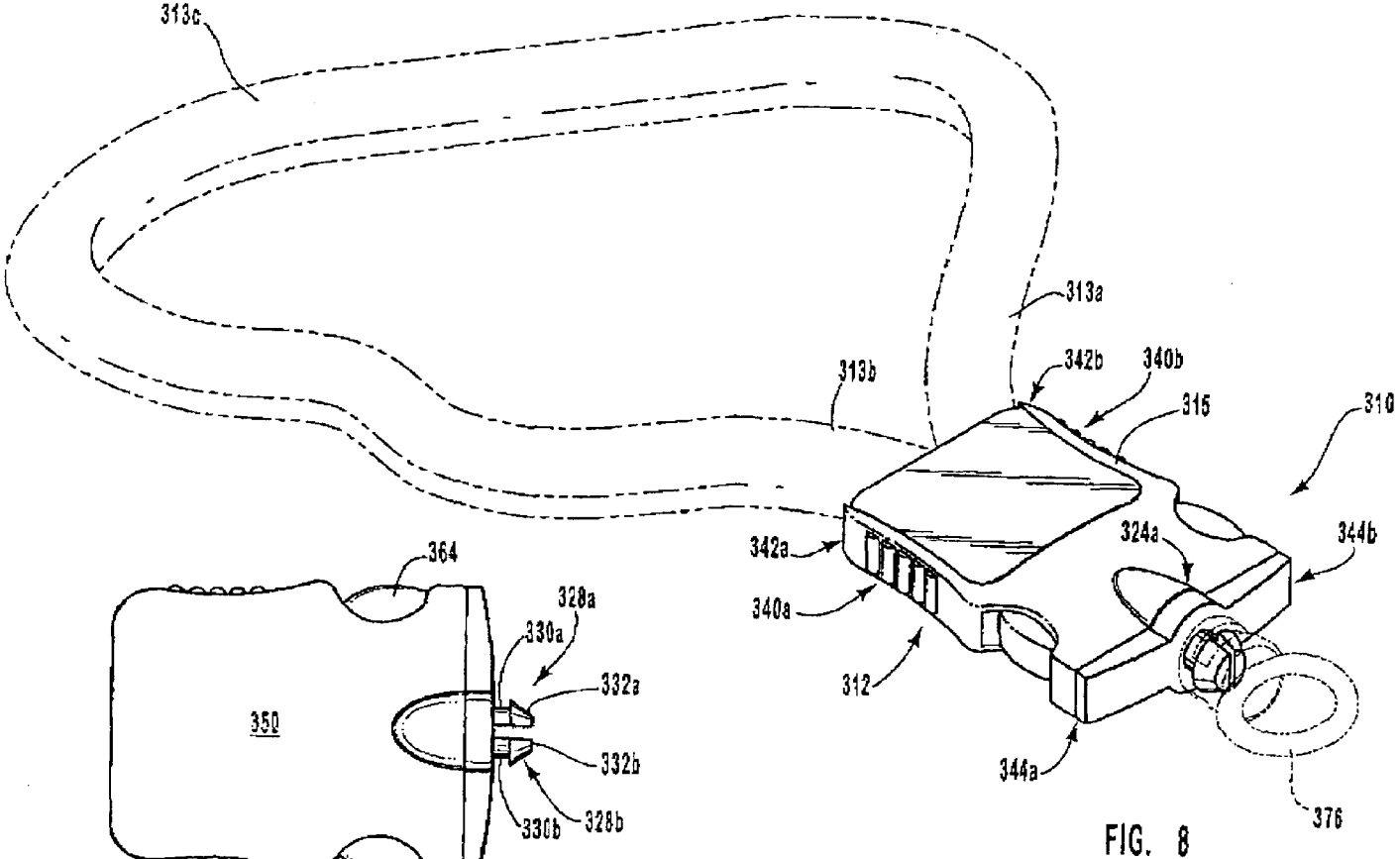
FIG. 4A is a bottom plan view of the lanyard connector of FIG. 1.
FIG. 8 is a perspective view of a lanyard connector system of FIG. 1, with the strap and the O-ring connected to the connector being shown in phantom lines.

With reference to FIGS. 1, 1*a* and FIG. 8, in one embodiment, upon mounting an attachment member such as clip 322 upon the split neck, skirt members 332*a*, 332*b* rotate along a ridge 370 (e.g., an annular ridge) located on the inner diameter portion of the base 372 of the attachment member. The ridge 370 is partially shown in FIG. 1. In one base embodiment, first and second opposing side members 374 (only one shown in FIG. 1) are mounted on the outer diameter portion of the base 372. In one embodiment, the interior portion of the base is tapered to allow convenient mounting of the attachment onto the neck. The interior portion can be non tapered, however. A variety of different attachment members may be rotatably mounted upon neck 14, as will be appreciated by one skilled in the art in light of this disclosure.

In one embodiment, it is possible to detach the attachment (e.g., 322) from the connector 310 upon applying sufficient force to move the parts apart e.g., by bending the connector 310 with respect to the attachment and pulling the parts apart, causing the skirt members 332*a*–*b* to move off ridge 370 and out of base 372.

Lanyard connector 310 may be comprised of a non-conductive material, such as a plastic material to thereby allow the connector 310 to be used in a variety of different settings where non-conductivity is desired, such as when working with computer and other electrical equipment. In addition, a non-conductive attachment (e.g., plastic) and lanyard substrate (e.g., knitted fabric) may be attached thereto to form an overall non-conductive lanyard system.

Lanyard connector 310 may be employed on a variety of different lanyard substrates, such as lanyard substrates having rounded ends, square ends and a variety of different shapes. In one embodiment, connector 310 is employed with a lanyard substrate material having relatively solid ends. In addition, it is possible to employ a lanyard substrate material having relatively flat ends that can be conveniently mounted within the body 312 of lanyard connector 310.

Figure 4:
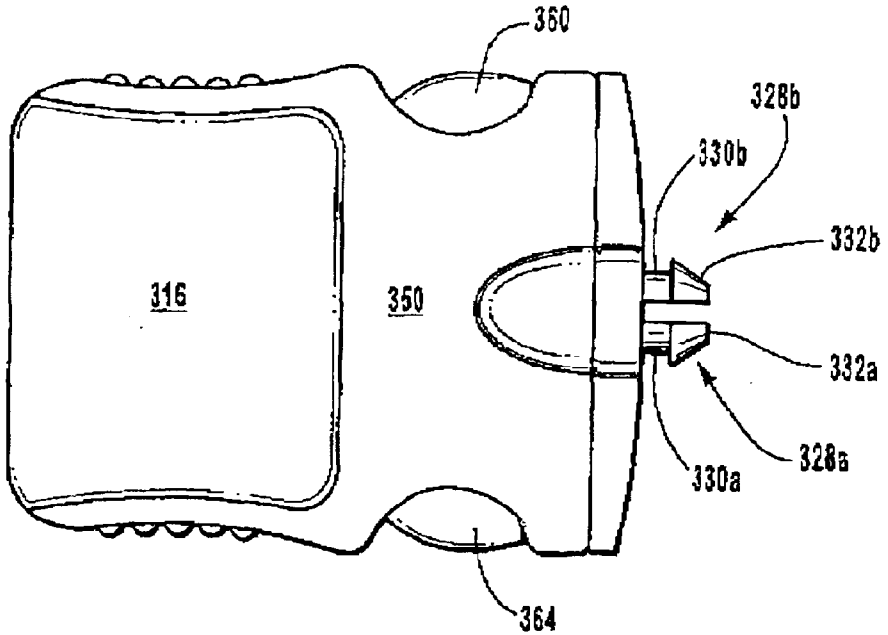
FIG. 4 is a top plan view of the lanyard connector of FIG. 1.
Figure 5:
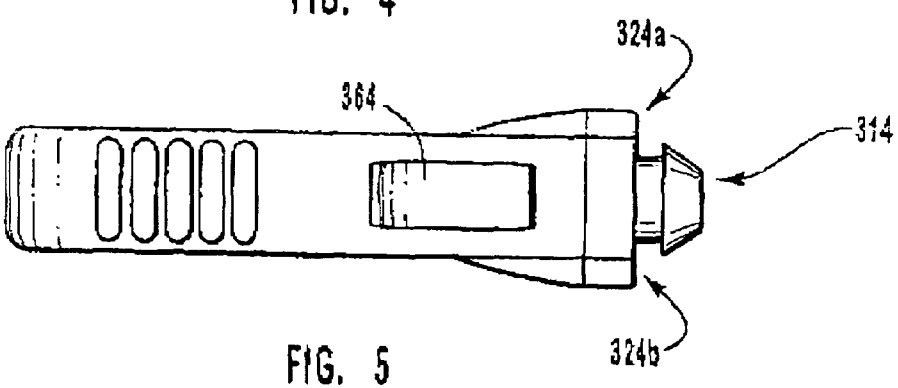
FIG. 5 is a side plan view of the lanyard connector of FIG. 1, the opposing side being the mirror image thereof.
Figure 6:
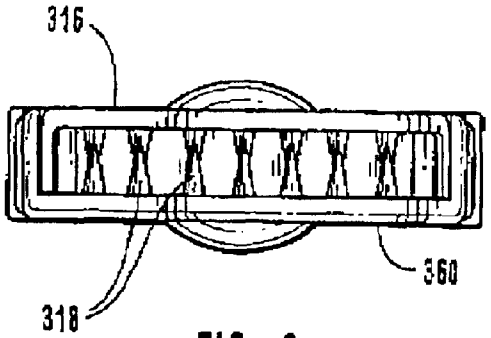
FIG. 6 is a rear end view of the lanyard connector of FIG. 1.
Figure 7:
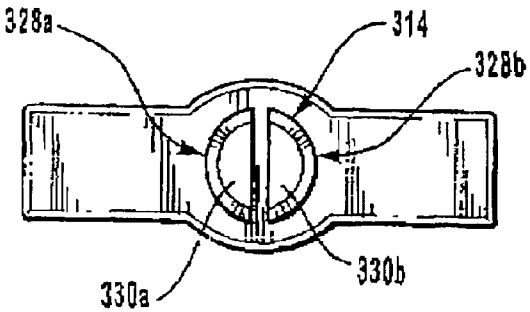
FIG. 7 is a front end view of the lanyard connector of FIG. 1.

As shown and discussed above, lanyard connector 310 comprises a proximal female buckle body portion 350 and a distal male buckle body portion 352 that selectively mounts into the female buckle portion 350. Proximal female buckle portion 350 comprises a plurality of recesses 354, 356, 358 (FIG. 2) that selectively receive corresponding protuberances 360, 362, 364 of distal body portion 352. Protuberances 360, 364 act as prongs of a buckle, thereby allowing a user to "buckle" the male buckle portion 352 into the female buckle portion 350. As shown, portions of protuberances 360, 364 extend out of apertures in body 350 after passing through the resepective recesses mentioned above. Protuberances 360, 364 are semi-rigid such that they are flexible enough to be buckled into respective apertures 366, 368, but are rigid enough to be maintained within the female portion, as shown in FIG. 4, until the user unbuckles the protuberances 360, 364 by pressing inwardly thereon and moving the parts apart (or in one embodiment until such a significant force is exerted to pull the protuberances from the apertures).

Figure 9:
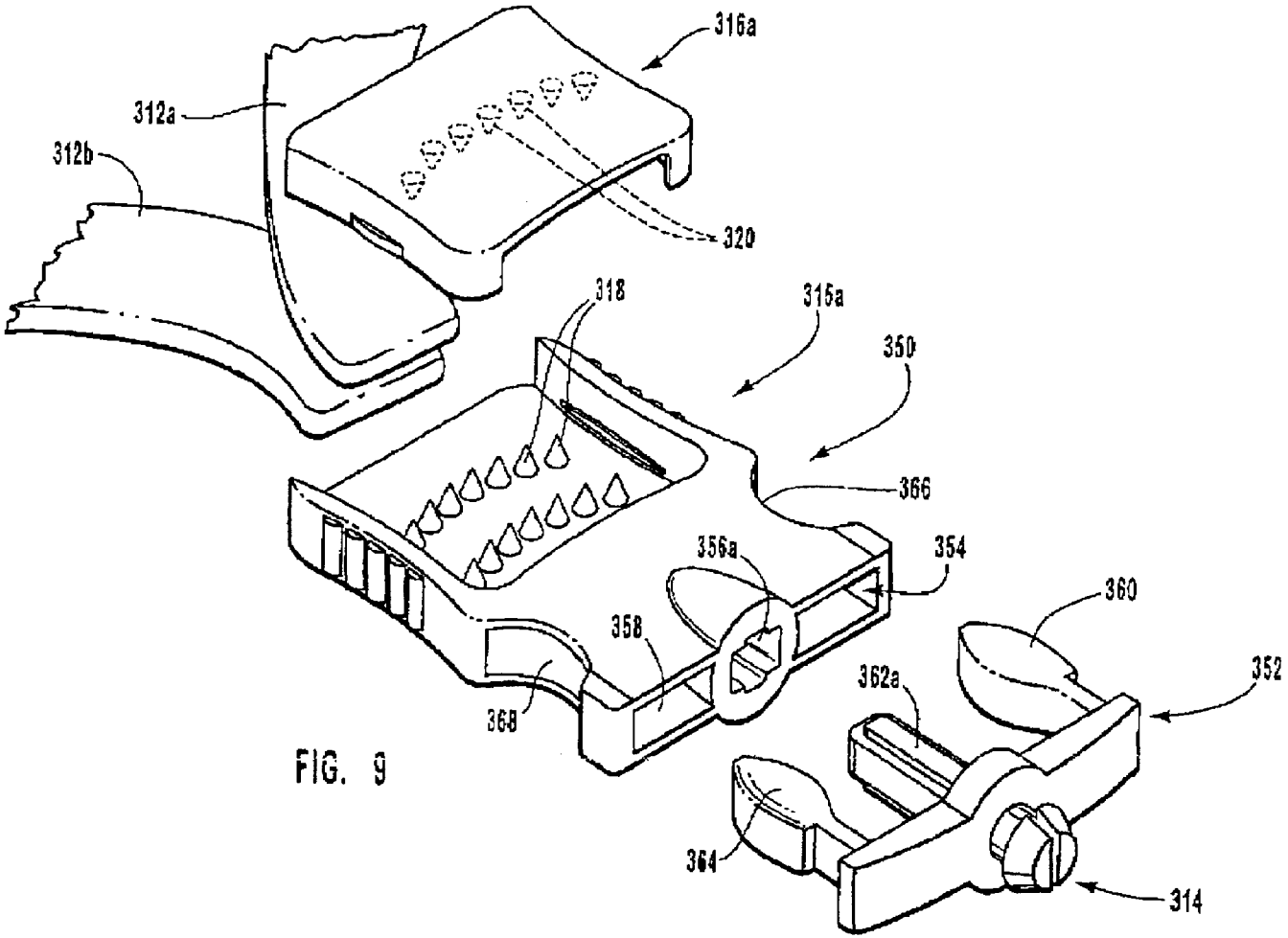
FIG. 9 is a view of an alternative system of the present invention.

Optional designs for certain protuberances 362*a* and mating recesses 356*a* are shown in FIGS. 3 and 9, although a variety of different configurations are available.

By providing a two-part male buckle portion, it is possible to provide multiple methods for disengaging the object coupled to the lanyard from the neck of the wearer. For example, the wearer can disengage an object direcly from the attachment, such as from a clip 322 as shown in FIG. 1, or the O-ring 376 shown in phantom in FIG. 8. Optionally, the wearer can disengage an attachment (e.g., attachment 322) from the male buckle portion 352, or the wearer can disengage the male buckle portion 352 from the male female buckle portion 350. The male buckle portion is modular on both ends of the male buckle portion, not merely on one end of the male buckle portion, such that the male buckle portion can be selectively attached to a variety of different lanyard substrates and/or attachments.

While injection molding of DELRIN or CELCON plastic is one method for manufacturing lanyard connector 310, and/or the attachments to be coupled thereto, a variety of different methods may be employed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A lanyard connector, comprising:

a lanyard connector body that is configured to be coupled to the ends of a lanyard substrate, the lanyard connector body having a proximal end and an opposing distal end, the ends of the lanyard substrate entering the lanyard connector body from the proximal end; and a coupling portion extending from the distal end of the lanyard connector body to thereby allow selective attachment of an attachment to the lanyard connector, wherein the lanyard connector body has first and second sides, each of the first and second sides having a groove therein which enables a user to conveniently grasp the lanyard connector on the sides thereof, wherein the body has upper and lower portions, each of the sides being thinner than the upper and lower portions.

2. A lanyard connector as recited in claim 1, wherein the grooves taper inwardly from proximal shoulders and distal shoulders.

3. A lanyard connector as recited in claim 1, wherein the upper and lower portions are located transversely with respect to the first and second sides, each of the sides being thinner than the upper and lower portions.

4. A lanyard connector as recited in claim 1, wherein the lanyard connector body has a clamshell configuration.

5. A lanyard connector as recited in claim 1, wherein the lanyard connector body comprises a male body portion and a female portion that receives the male body portion therein.

6. A lanyard connector as recited in claim 1, wherein the lanyard connector body has a clamshell configuration having a male portion and a female portion, the male portion fitting in mating relationship within the female portion.

7. A lanyard connector, comprising:

a lanyard connector body that is configured to be coupled to the ends of a lanyard substrate, the lanyard connector body having a proximal end and an opposing distal end, the lanyard substrate entering the lanyard connector body from the proximal end; and a coupling portion extending from the distal end of the lanyard connector body to thereby allow selective attachment of an attachment to the lanyard connector, wherein the lanyard connector body has opposing upper and lower portions and opposing first and second sides, each of the sides being transverse to the upper and lower portions of the lanyard connector body, each of the first and second sides having a groove therein which enables a user to conveniently grasp the lanyard connector on the sides thereof, wherein each of the sides is thinner than the upper and lower portions.

8. A lanyard connector as recited in claim 7, wherein the lanyard connector body has a clamshell configuration.

9. A lanyard connector as recited in claim 7, wherein the lanyard connector body comprises a male body portion and a female portion that receives the male body portion therein.

10. A lanyard connector as recited in claim 7, wherein the grooves taper inwardly from proximal shoulders and distal shoulders.

11. A lanyard, comprising:

a lanyard substrate having first and second ends;

a lanyard connector body that is configured to be coupled to the ends of the lanyard substrate, the lanyard connector body having a proximal end and an opposing distal end, the lanyard substrate entering the lanyard connector body from the proximal end; and a coupling portion extending from the distal end of the lanyard connector body to thereby allow selective attachment of an attachment to the lanyard connector, wherein the lanyard connector body has first and second sides, each of the first and second sides having a groove therein which enables a user to conveniently grasp the lanyard connector on the sides thereof, wherein each of the sides is thinner than the upper and lower portions.

12. A lanyard connector as recited in claim 11, wherein the lanyard connector body has a clamshell configuration.

13. A lanyard connector as recited in claim 11, wherein the lanyard connector body comprises a male body portion and a female portion that receives the male body portion therein.

* * * * *

UNITED STATES PATENT AND TRADEMARK OFFICE

CERTIFICATE OF CORRECTION

PATENT NO. : 6,711,785 B1
DATED : March 30, 2004
INVENTOR(S) : Hicks et al.

It is certified that error appears in the above-identified patent and that said Letters Patent is hereby corrected as shown below:

Title page,
Item [56], References Cited, U.S. PATENT DOCUMENTS, insert
-- D405,725 2/1999 Anscher……D11/216 --

Column 1,
Line 8, change "which,is" to -- which is --

Column 10,
Line 19, remove the phrase "configured to be"
Line 31, after "than" remove "the"
Line 32, after "portions" insert -- of the lanyard connector body --

Signed and Sealed this

Twelfth Day of October, 2004

JON W. DUDAS
*Director of the United States Patent and Trademark Office*